US011261866B2

(12) United States Patent
Kaida et al.

(10) Patent No.: US 11,261,866 B2
(45) Date of Patent: Mar. 1, 2022

(54) COMPRESSOR HAVING EXTERNAL TEMPERATURE SENSOR AND METHOD OF MANUFACTURING COMPRESSOR

(71) Applicant: DAIKIN INDUSTRIES, LTD., Osaka (JP)

(72) Inventors: Hirohito Kaida, Osaka (JP); Takekazu Obitani, Osaka (JP); Hitoshi Shibata, Osaka (JP); Yasutaka Ueno, Osaka (JP); Yuusuke Fujii, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/265,778

(22) PCT Filed: Aug. 2, 2019

(86) PCT No.: PCT/JP2019/030511

§ 371 (c)(1),
(2) Date: Feb. 3, 2021

(87) PCT Pub. No.: WO2020/031896

PCT Pub. Date: Feb. 13, 2020

(65) Prior Publication Data

US 2021/0310489 A1 Oct. 7, 2021

(30) Foreign Application Priority Data

Aug. 9, 2018 (JP) ..... JP2018-150593

(51) Int. Cl.
*F25D 29/00* (2006.01)
*F04C 14/28* (2006.01)
(Continued)

(52) U.S. Cl.
CPC ..... *F04C 29/00* (2013.01); *F25D 29/005* (2013.01); *F04C 2/04* (2013.01); *F04C 2230/231* (2013.01); *F04C 2240/30* (2013.01)

(58) Field of Classification Search
CPC ..... F04C 14/28; F04C 28/28; F04C 2230/60; F04C 29/00; F04C 2270/19; F04C 2230/231; F25D 29/005
(Continued)

(56) References Cited

U.S. PATENT DOCUMENTS 4,403,102 A * 9/1983 Jordan ..... H01L 23/4006 165/80.3
5,632,912 A * 5/1997 Cecil ..... B23K 11/14 219/110
(Continued)

FOREIGN PATENT DOCUMENTS

CN 101675246 A 3/2010
EP 3 779 199 A1 2/2021
(Continued)

OTHER PUBLICATIONS

International Preliminary Report of corresponding PCT Application No. PCT/JP2019/030511 dated Feb. 9, 2021.
(Continued)

*Primary Examiner* — Deming Wan
(74) *Attorney, Agent, or Firm* — Global IP Counselors, LLP

(57) ABSTRACT

A compressor includes a casing having a cylindrical portion, a compression mechanism fixed to an inner peripheral surface of the cylindrical portion, an external portion, a weld nut, and a bolt. The external portion includes a temperature reaction portion that reacts to a temperature change of the cylindrical portion. The external portion is mounted on an outer peripheral surface of the cylindrical portion. The weld nut is welded to the outer peripheral surface of the cylindrical portion to mount the external portion on the outer peripheral surface of the cylindrical portion. The bolt fixes the external portion to the weld nut.

22 Claims, 6 Drawing Sheets

(51) Int. Cl.

| | |
|---|---|
| ***F04C 28/28*** | (2006.01) |
| ***F16B 37/06*** | (2006.01) |
| ***F04C 29/00*** | (2006.01) |
| *F04C 2/04* | (2006.01) |

(58) Field of Classification Search
USPC ..... 248/200, 213.2, 230.1, 300, 309.1, 901, 248/904; 411/171
See application file for complete search history.

(56) References Cited

U.S. PATENT DOCUMENTS

| | | | | |
|---|---|---|---|---|
| 7,618,012 | B2 * | 11/2009 | Itoh | F16B 5/0241 248/220.21 |
| 2007/0125690 | A1 * | 6/2007 | Hakola | B04C 5/14 209/715 |
| 2008/0078191 | A1 | 4/2008 | Morishita et al. | |
| 2009/0297291 | A1 * | 12/2009 | Schmidt | B23P 19/062 411/180 |
| 2010/0028184 | A1 | 2/2010 | Hahn | |
| 2010/0132389 | A1 | 6/2010 | Nishide et al. | |
| 2012/0294733 | A1 | 11/2012 | Kamada et al. | |
| 2015/0060028 | A1 * | 3/2015 | Irmler | F28D 7/1638 165/157 |
| 2016/0116183 | A1 * | 4/2016 | Lazar | G05D 23/1905 236/1 C |
| 2016/0178411 | A1 * | 6/2016 | Sedory | E01B 9/10 324/207.15 |
| 2017/0019000 | A1 * | 1/2017 | Sakamoto | H02K 11/25 |
| 2017/0248451 | A1 * | 8/2017 | Ginet | G01D 11/30 |

FOREIGN PATENT DOCUMENTS

| | | | |
|---|---|---|---|
| JP | 10-80792 | A | 3/1998 |
| JP | 2008-106738 | A | 5/2008 |
| JP | 2011-169316 | A | 9/2011 |

OTHER PUBLICATIONS

International Preliminary Report of corresponding PCT Application No. PCT/JP2019/030511 dated Feb. 18, 2021.
International Search Report of corresponding PCT Application No. PCT/JP2019/030511 dated Oct. 8, 2019.
European Search Report of corresponding EP Application No. 19 84 8275.4 dated Aug. 23, 2021.

* cited by examiner

COMPRESSOR HAVING EXTERNAL TEMPERATURE SENSOR AND METHOD OF MANUFACTURING COMPRESSOR

CROSS-REFERENCE TO RELATED APPLICATIONS

This U.S. National stage application claims priority under 35 U.S.C. § 119(a) to Japanese Patent Application No. 2018-150593, filed in Japan on Aug. 9, 2018, the entire contents of which are hereby incorporated herein by reference.

BACKGROUND

Field of the Invention

The present disclosure relates to a compressor and a method of manufacturing the compressor.

Background Information

A conventional compressor is provided with a temperature sensor that measures the temperature of the compressor, in order to maintain the reliability of the compressor. For example, a discharge temperature sensor is provided on an outer peripheral surface of a casing of the compressor disclosed in JP 2008-106738 A.

SUMMARY

Welding performed for mounting a temperature sensor to a casing requires a large amount of heat input, thus entailing a risk of deformation and breakage of the casing due to the heat.

A compressor according to a first aspect includes a casing, an external portion, a weld nut, and a bolt. The casing has a cylindrical portion. A compression mechanism is fixed to an inner peripheral surface of the cylindrical portion. The external portion is mounted on an outer peripheral surface of the cylindrical portion. The external portion includes a temperature reaction portion that reacts to a temperature change of the cylindrical portion. The weld nut is welded to the outer peripheral surface of the cylindrical portion. The weld nut is for mounting the external portion on the outer peripheral surface of the cylindrical portion. The bolt fixes the external portion to the weld nut.

Here, only the weld nut is mounted on the outer peripheral surface of the cylindrical portion, making it possible to perform welding with a small amount of heat input. This suppresses the deformation and breakage of the casing.

A compressor according to a second aspect is the compressor according to the first aspect, wherein a plurality of the weld nuts is arranged along a first direction, which is an axial direction of the cylindrical portion.

Here, even if the weld nuts are somewhat misaligned when mounted, the influence on a holding portion required for manufacturing the compressor is small.

A compressor according to a third aspect is the compressor according to the first or second aspect, wherein a position of the temperature reaction portion in the first direction falls within a range of a fixing portion in the first direction, the fixing portion fixes the compression mechanism to the cylindrical portion.

Here, limiting the position of the temperature reaction portion makes it possible for the temperature reaction portion to quickly measure the heat generated by the compression mechanism 20.

A compressor according to a fourth aspect is the compressor according to any of the first to third aspects, wherein the weld nut is welded to the outer peripheral surface of the cylindrical portion by projection welding or spot welding.

As a result, welding can be performed with a small amount of heat input.

A compressor according to a fifth aspect is the compressor according to any of the first to fourth aspects, wherein the weld nut is welded to the outer peripheral surface of the cylindrical portion by projection welding.

A compressor according to a sixth aspect is the compressor according to any of the first to fifth aspects, further including an attaching member and an attaching spring. The attaching member and the attaching spring are for bringing the temperature reaction portion into close contact with the cylindrical portion.

Here, the attaching member and the attaching spring increase the degree of close contact between the temperature reaction portion and the outer peripheral surface of the cylindrical portion. As a result, the temperature reaction portion can measure the temperature more accurately.

A compressor according to a seventh aspect is the compressor according to any of the first to sixth aspects, wherein the external portion further includes an elastic heat transfer sheet. The heat transfer sheet is mounted between the temperature reaction portion and the cylindrical portion.

Here, mounting the heat transfer sheet increases the degree of close contact between the temperature reaction portion and the cylindrical portion. As a result, the temperature reaction portion can measure the temperature of the cylindrical portion more accurately.

A compressor according to an eighth aspect is the compressor according to any of the first to seventh aspects, wherein the cylindrical portion has an outer diameter ranging from 80 mm to 160 mm. A length of the temperature reaction portion along a circumferential direction of the cylindrical portion ranges from 10 mm to 20 mm.

Here, limiting the outer diameter of the cylindrical portion and the length of the temperature reaction portion along the circumferential direction of the cylindrical portion increases the degree of close contact between the temperature reaction portion and the cylindrical portion.

A compressor according to a ninth aspect is a method of manufacturing the compressor according to any of the first to eighth aspects, wherein the casing includes a top portion and a bottom portion located at both ends of the cylindrical portion. The compressor is manufactured in order of a first step, a second step, a third step, and a fourth step. In the first step, the weld nut is welded to the outer peripheral surface of the cylindrical portion. In the second step, the compression mechanism is welded to the inner peripheral surface of the cylindrical portion. In the third step, the top portion and the bottom portion of the casing are welded to the cylindrical portion. In the fourth step, the external portion is mounted on the outer peripheral surface of the cylindrical portion.

Here, manufacturing the compressor in the order of the first step, the second step, the third step, and the fourth step makes it possible to mount the external portion without changing the conventional manufacturing line.

DETAILED DESCRIPTION OF EMBODIMENT(S)

(1) Overall Configuration

Figure 1:
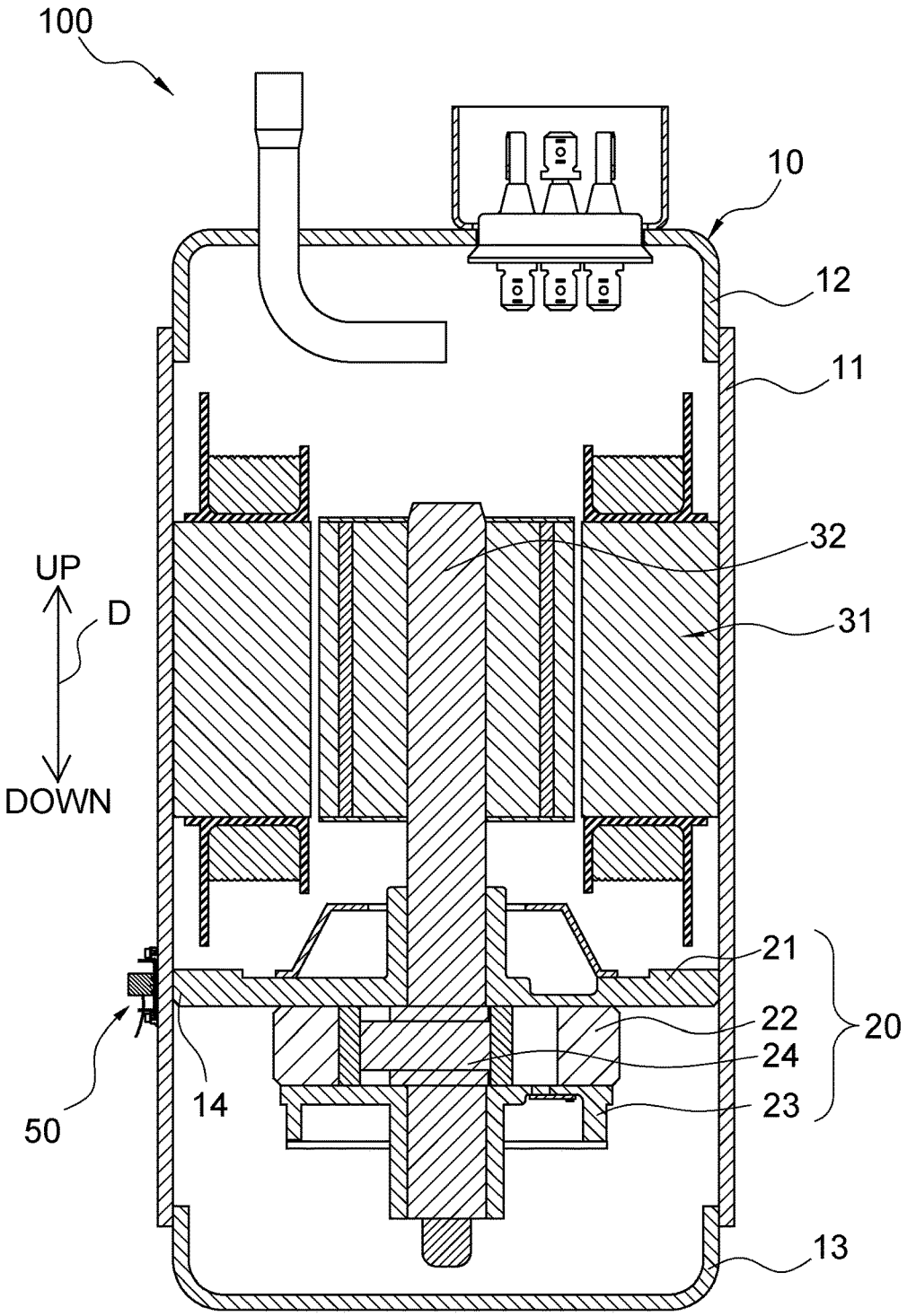
FIG. 1 is a vertical sectional view illustrating the overall configuration of a rotary compressor.
Figure 2:
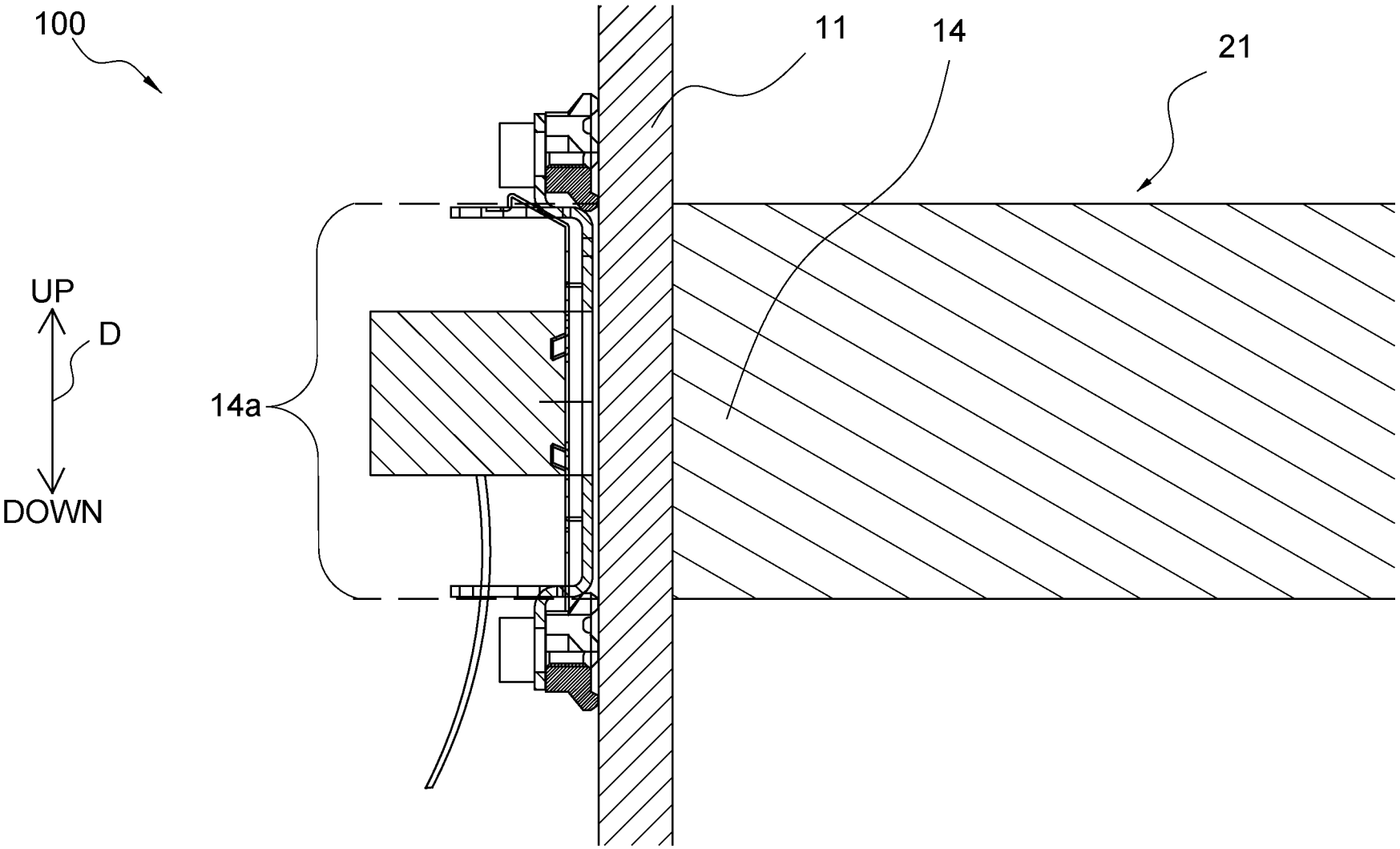
FIG. 2 is an enlarged view of the vicinity of a fixing portion.
Figure 3:
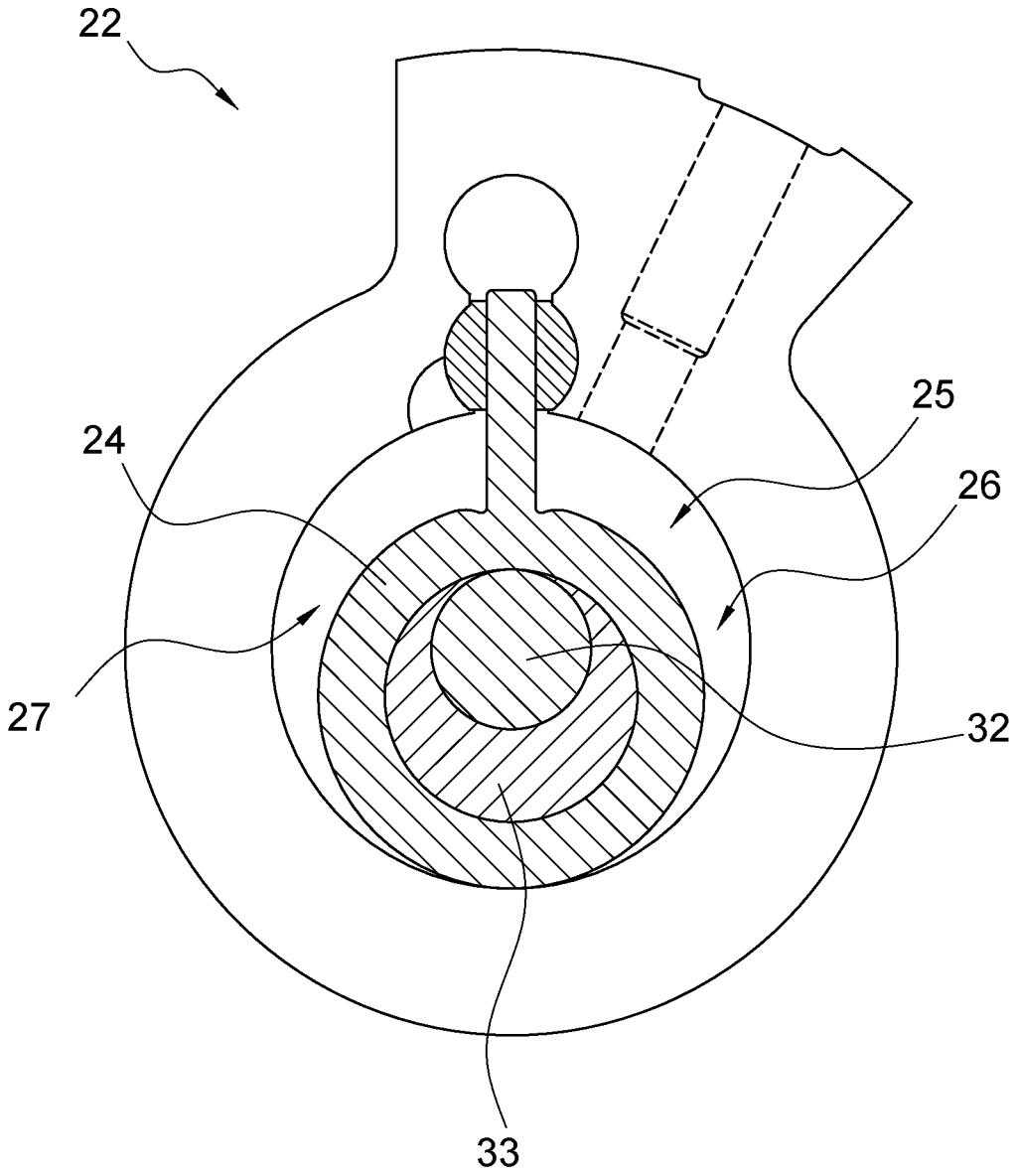
FIG. 3 is a lateral sectional view of a cylinder.

FIG. 1 is a vertical sectional view illustrating the overall configuration of a compressor 100. FIG. 2 is an enlarged view of the vicinity of a fixing portion 14. FIG. 3 is a lateral sectional view of a cylinder 22. The compressor 100 is used, for example, in an outdoor unit of an air conditioner.

As illustrated in FIG. 1, the compressor 100 includes a casing 10. The casing 10 has a cylindrical portion 11 having a cylindrical shape, a bowl-shaped top portion 12, and a bowl-shaped bottom portion 13. In the following, the axial direction of the cylindrical portion 11 is defined as a first direction D; the direction toward the top portion 12 of the casing 10 is upward, while the direction toward the bottom portion 13 of the casing 10 is downward. The top portion 12 is airtightly bonded to an upper end portion of the cylindrical portion 11. The bottom portion 13 is airtightly bonded to a lower end portion of the cylindrical portion 11. In the present disclosure, the outer diameter of the cylindrical portion 11 of the casing 10 ranges from 80 mm to 160 mm.

A compression mechanism 20, a drive motor 31, and a crankshaft 32 are mainly housed inside the casing 10. An external portion 50 is mounted to an outer portion of the casing 10 with a weld nut 55 and a bolt 56.

The compression mechanism 20 mainly includes a front head 21, the cylinder 22, a rear head 23, and a piston 24. The front head 21 includes the fixing portion 14. The fixing portion 14 is welded to the inner peripheral surface of the cylindrical portion 11 of the casing 10. As illustrated in FIG. 2, the range of the cylindrical portion 11 in the first direction D where the fixing portion 14 is welded is defined as a fixing range 14*a*.

The front head 21, the cylinder 22, and the rear head 23 are integrally fastened with bolts to form a compression chamber 25 inside (see FIG. 3). The compression chamber 25 is divided into a suction chamber 26 and a discharge chamber 27 by the piston 24. The compression mechanism 20 is coupled to the drive motor 31 via the crankshaft 32. The drive motor 31 rotates the crankshaft 32 using electric power supplied from a power source provided outside the compressor. Inside the compression chamber 25, the piston 24 rotates around an eccentric shaft 33 of the crankshaft 32. As a result, the volumes of the suction chamber 26 and the discharge chamber 27 change periodically, and refrigerant is compressed.

Figure 4:
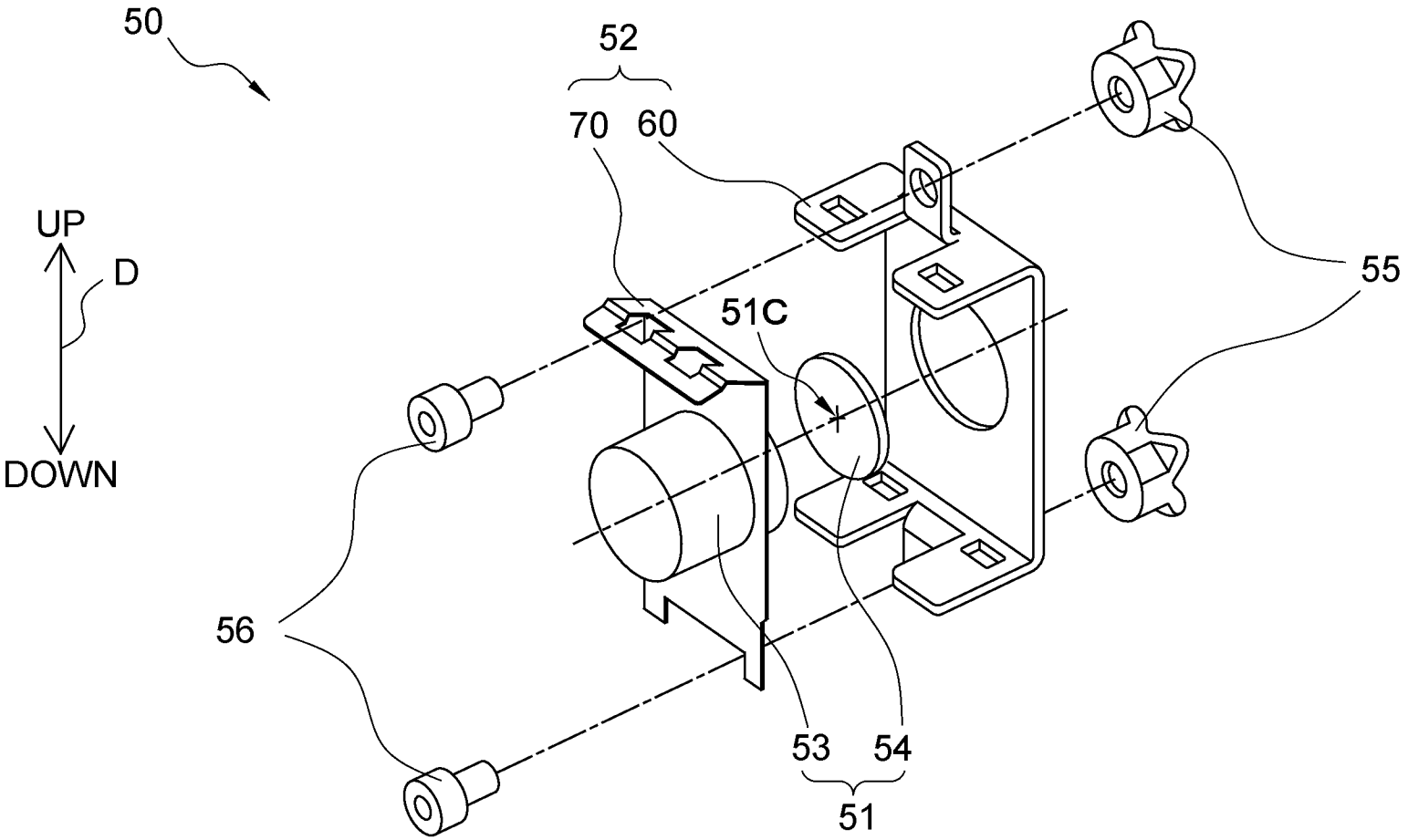
FIG. 4 is a schematic view of an external portion.

The external portion 50 is mounted on the outer peripheral surface of the cylindrical portion 11 of the casing 10. As illustrated in FIG. 4, the external portion 50 includes a sensor portion 51 and a mounting portion 52. The sensor portion 51 and the mounting portion 52 are fixed, with the bolts 56, to the weld nuts 55 welded to the outer peripheral surface of the cylindrical portion 11. The external portion 50 measures the temperature of the cylindrical portion 11. The temperature of the cylindrical portion 11 rises due to the heat transferred from the compression mechanism 20. The information about the measured temperature is transmitted to, for example, a control unit of the air conditioner.

(2) Detailed Configuration of External Portion (2-1) Sensor Portion

The sensor portion 51 includes a temperature reaction portion 53 and a heat transfer sheet 54.

The temperature reaction portion 53 measures the temperature of the cylindrical portion 11. The temperature of the cylindrical portion 11 rises due to the heat transferred from the compression mechanism 20. The length of the temperature reaction portion 53 along the circumferential direction of the cylindrical portion 11 ranges from 10 mm to 20 mm. A lead wire 57 (see FIG. 2) is connected to the temperature reaction portion 53. The lead wire 57 transmits the information about the temperature measured by the temperature reaction portion 53 to, for example, a control unit provided outside the compressor 100.

The heat transfer sheet 54 has good thermal conductivity and elasticity. The heat transfer sheet 54 is disposed between the temperature reaction portion 53 and the cylindrical portion 11 of the casing 10. The sensor portion 51 is pressed by the mounting portion 52, which will be described later, and is mounted so as to be in close contact with the outer peripheral surface of the cylindrical portion 11. The sensor portion 51 has a center point 51C at the center of an attachment surface that comes in close contact with the cylindrical portion 11.

(2-2) Mounting Portion

The mounting portion 52 includes an attaching member 60 and an attaching spring 70.

Figure 5A:
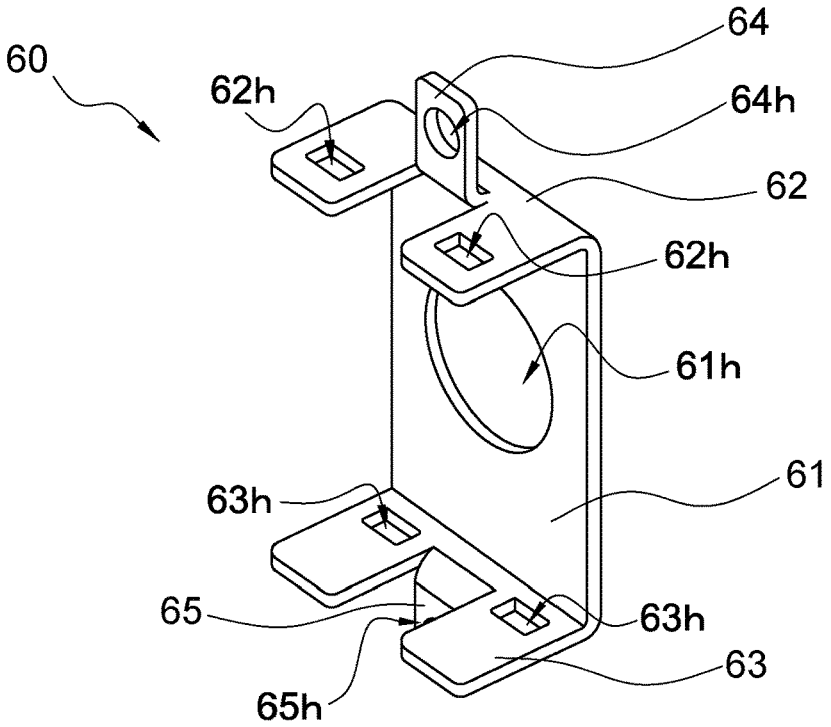
FIG. 5A is a schematic view of an attaching member.

The attaching member 60 is formed by pressing of a thin plate-shaped metal member. As illustrated in FIG. 5A, the attaching member 60 includes a main plate portion 61, a first side plate portion 62, a second side plate portion 63, a first fastening portion 64, and a second fastening portion 65.

The main plate portion 61 has a substantially rectangular shape with an opening 61*h* formed in the center. The sensor portion 51 is disposed in the opening 61*h* so as to be in close contact with the cylindrical portion 11.

The first side plate portion 62 rises vertically from an upper end portion of the main plate portion 61 in the first direction D. The first side plate portion 62 has fitting holes 62*h*. The fitting holes 62*h* each have a shape to be fitted to a fitting portion 72 of the attaching spring 70 described later. Here, a part of the first side plate portion 62 further rises upward in the first direction D to form the first fastening portion 64. A first bolt hole 64*h*, into which one of the bolts 56 is inserted, is formed in a central portion of the first fastening portion 64.

The second side plate portion 63 rises vertically from a lower end portion of the main plate portion 61 in the first direction D. The second side plate portion 63 has insertion holes 63*h*. The insertion holes 63*h* each have a shape to be fitted to an insertion portion 73 of the attaching spring 70 described later. Here, a part of the second side plate portion 63 further rises downward in the first direction D to form the second fastening portion 65. A second bolt hole 65*h*, into which the other bolt 56 is inserted, is formed in a central portion of the second fastening portion 65.

Figure 5B:
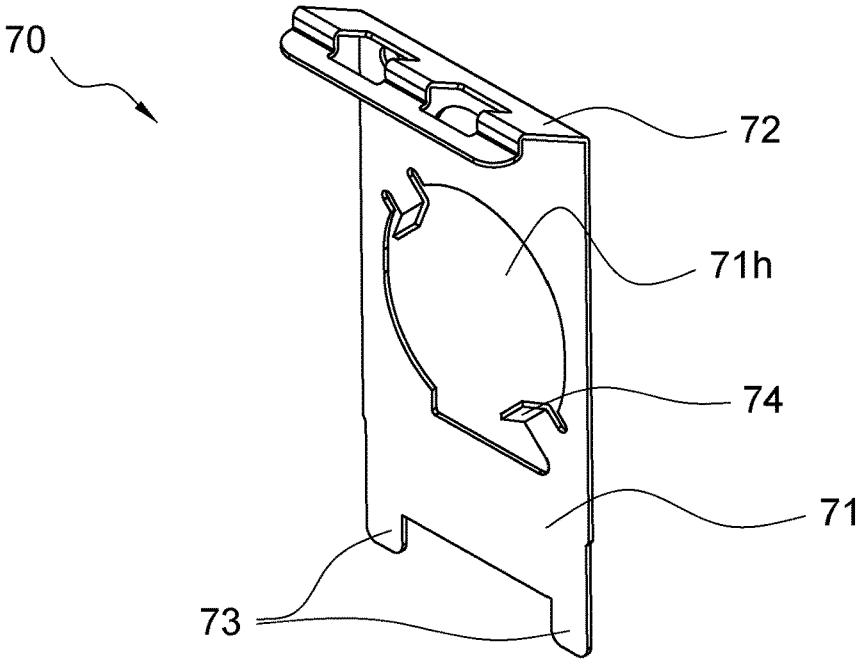
FIG. 5B is a schematic view of an attaching spring.

The attaching spring 70 is formed by pressing of a thin plate-shaped metal spring member. The attaching spring 70 includes a main plate portion 71, the fitting portion 72, and the insertion portions 73 as illustrated in FIG. 5B.

The main plate portion 71 has a substantially rectangular shape with an opening 71*h* formed in a central portion. The opening 71*h* communicates with the opening 61*h* formed in the main plate portion 61 of the attaching member 60. A plurality of claws 74 is formed in the opening 71*h* of the attaching spring 70. Each of the claws 74 protrudes toward a central portion of the opening 71*h*. The claws 74 are for holding the temperature reaction portion 53 disposed in the opening 71*h*.

The fitting portion 72 extending from the main plate portion 71 of the attaching spring 70 has a spring shape including a plurality of bent portions. The spring shape of the fitting portion 72 is partially fitted into the fitting holes 62*h* formed in the first side plate portion 62 of the attaching member 60. As a result, the sensor portion 51 is pressed against the outer peripheral surface of the cylindrical portion 11.

The insertion portions 73 each extend from the main plate portion 71 along the first direction D and have a shape to be fitted into one of the insertion holes 63*h*.

(3) Steps of Assembling Compressor

Next, the steps of assembling the compressor 100 will be described. The present disclosure implements the assembling steps with minimum changes in a conventionally used manufacturing line for a compressor. The assembling steps are performed in the order of a first step, a second step, a third step, and a fourth step.

First, in the first step, the weld nuts 55 are welded to the outer peripheral surface of the cylindrical portion 11 of the casing 10. The weld nuts 55 are welded to the outer peripheral surface of the cylindrical portion 11 such that the position of the center point 51C in the sensor portion 51 falls within the fixing range 14*a*. The weld nuts 55 are welded so as to line up along the first direction D. The method of welding the weld nuts 55 is projection welding.

After the weld nuts 55 have been welded, in the second step, the compression mechanism 20, the drive motor 31, the crankshaft 32, and the like are housed inside the casing 10. At this time, the fixing portion 14 is welded to the inner peripheral surface of the cylindrical portion 11.

Next, in the third step, the top portion 12 and the bottom portion 13 of the casing 10 are airtightly welded to the cylindrical portion 11.

Finally, in the fourth step, the external portion 50 is mounted on the outer peripheral surface of the cylindrical portion 11. The bolts 56 are made to pass through the first bolt hole 64*h* and the second bolt hole 65*h* of the attaching member 60, and are fastened to the weld nuts 55 welded in the first step. The temperature reaction portion 53 is disposed in the opening 71*h* in the main plate portion 71 of the attaching spring 70. The claws 74 hold the temperature reaction portion 53. Then, the insertion portions 73 formed on the attaching spring 70 are inserted into the insertion holes 63*h* formed in the second side plate portion 63 of the attaching member 60. The fitting portion 72 formed on the attaching spring 70 is fitted into the fitting holes 62*h* formed in the first side plate portion 62 of the attaching member 60.

(4) Characteristics (4-1)

The compressor 100 according to the present disclosure includes the external portion 50 having the temperature reaction portion 53. The external portion 50 is fixed to the outer peripheral surface of the cylindrical portion 11 with the weld nuts 55 and the bolts 56. Welding the weld nuts 55 to the outer peripheral surface of the cylindrical portion 11 reduces the area to be welded, as compared with a case where the external portion 50 is welded to the outer peripheral surface of the cylindrical portion 11. As a result, the amount of heat input is reduced, and deformation and breakage of the casing 10 are suppressed. Welding the weld nuts 55 by projection welding makes it possible to fix the weld nuts 55 with a small amount of heat input.

(4-2)

The external portion 50 is mounted on the outer peripheral surface of the cylindrical portion 11 such that the center point 51C falls within the fixing range 14*a*. The heat generated by the compression mechanism 20 is transferred to the external portion 50 via the fixing portion 14 and the cylindrical portion 11. Therefore, the external portion 50 can quickly measure the heat generated by the compression mechanism 20. This makes it possible to promptly detect the abnormality of the compressor 100.

(4-3)

The sensor portion 51 is in very close contact with the outer peripheral surface of the cylindrical portion 11, and can therefore measure the temperature of the compression mechanism 20 more accurately. In the present disclosure, the outer diameter of the cylindrical portion 11 ranges from 80 mm to 160 mm. The length of the temperature reaction portion 53 along the circumferential direction of the cylindrical portion 11 ranges from 10 mm to 20 mm. As a result, the proportion of the attachment area between the sensor portion 51 and the outer peripheral surface of the cylindrical portion 11 can be maintained at a certain level or higher, thus improving the degree of close contact.

The sensor portion 51 includes the heat transfer sheet 54. The elasticity of the heat transfer sheet 54 can increase the degree of close contact with the cylindrical shape of the cylindrical portion 11. The sensor portion 51 is pressed against the cylindrical portion 11 by the spring effect of the mounting portion 52. This can further increase the degree of close contact between the sensor portion 51 and the outer peripheral surface of the cylindrical portion 11.

(4-4)

Conventionally, in order to manufacture a compressor, a machine that manufactures the compressor needs to have a holding portion for holding a casing. Therefore, in a case where the external portion is mounted on the outer peripheral surface of the cylindrical portion of the casing at the beginning of the manufacturing steps, the position of a chuck is heavily limited. In this case, the manufacturing line needs to be changed in order to secure the chuck, which incurs a large cost.

In the present disclosure, as described above, the compressor 100 is manufactured in the order of the first step, the second step, the third step, and the fourth step. In the first step, only the weld nuts 55 are welded first, to minimize the limitation of the position of the holding portion. As a result, the external portion 50 can be mounted without changing the manufacturing line.

(4-5)

The weld nuts 55 are welded along the first direction D, which is the axial direction of the cylindrical portion 11. Even if the welding positions of the weld nuts 55 are somewhat misaligned, a distance H1 between the outer peripheral surface of the cylindrical portion 11 and the attaching member 60 is kept constant.

Figure 6A:
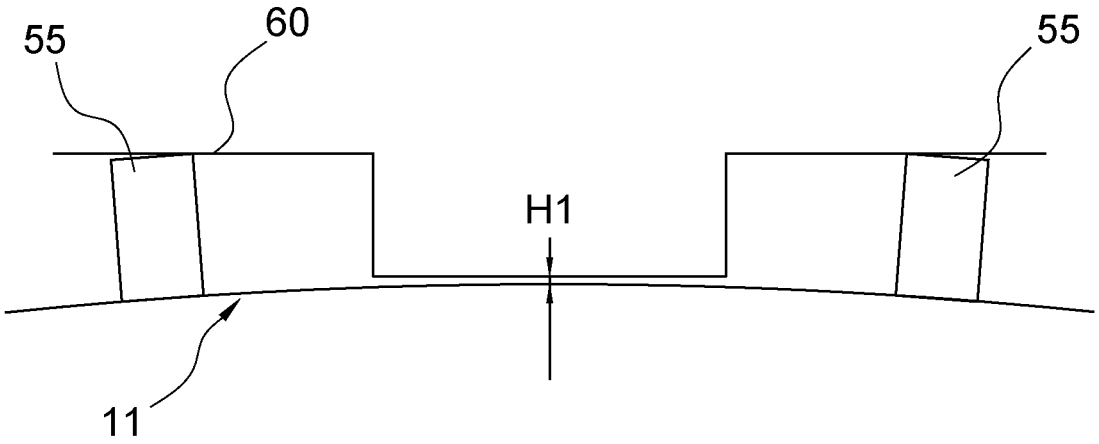
FIG. 6A is a conceptual diagram of weld nuts and the attaching member.
Figure 6B:
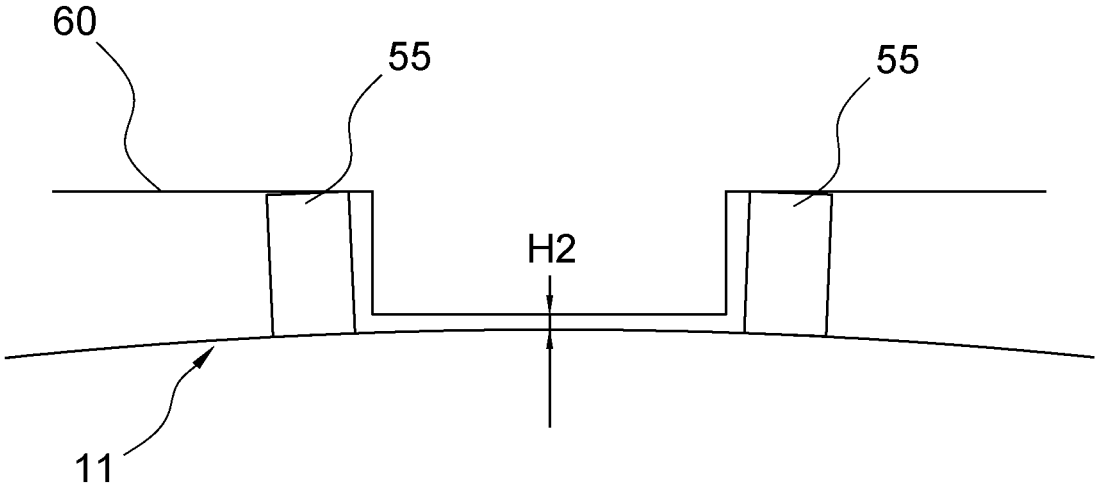
FIG. 6B is a conceptual diagram of the weld nuts and the attaching member.

FIG. 6 illustrates the weld nuts 55 welded along the circumferential direction of a cylindrical portion 11*a*. FIG. 6A is a diagram illustrating a case where weld nuts 55*a* are not misaligned. There is the distance H1 between an attaching member 60*a* and the cylindrical portion 11*a*. FIG. 6B is a diagram illustrating a case where weld nuts 55*b* are misaligned. There is a distance H2 between an attaching member 60*b* and a cylindrical portion 11*b*. If the welding positions of the weld nuts are misaligned, the distance between the attaching member and the cylindrical portion changes. Specifically, the distance H1 is smaller than the distance H2.

The misalignment of the weld nuts increases the distance between the attaching member and the cylindrical portion, thereby decreasing the degree of close contact between the sensor portion and the outer peripheral surface of the cylindrical portion. When the weld nuts are welded along the first direction D, which is the axial direction of the cylindrical portion 11, it is possible to suppress the decrease in the degree of close contact caused by the misalignment.

(5) Modifications

Modifications of the present embodiment will be described below. Note that a plurality of modifications may be appropriately combined, for example, as long as they do not contradict each other.

(5-1) Modification 1

The compressor 100 of the present disclosure is a rotary compressor. Alternatively, the present disclosure may be implemented using a scroll compressor.

(5-2) Modification 2

The compressor 100 of the present disclosure is a one-cylinder type compressor having one cylinder. Alternatively, the present disclosure may be implemented using a two-cylinder type compressor having two cylinders.

(5-3) Modification 3

The compression mechanism 20 of the present disclosure includes the front head 21 having the fixing portion 14. Alternatively, the cylinder or the rear head may have the fixing portion.

(5-4) Modification 4

The weld nuts 55 of the present disclosure may be welded by spot welding, for example. The spot welding can be performed with a small amount of heat input. This suppresses the deformation and breakage of the casing.

The embodiments of the present disclosure have been described above. It is understood that various modifications to modes and details will be available without departing from the gist and scope of the present disclosure recited in the claims.

What is claimed is:

1. A method of manufacturing a compressor that includes a casing having a cylindrical portion and including a top portion and a bottom portion located at ends of the cylindrical portion, a compression mechanism fixed to an inner peripheral surface of the cylindrical portion;

an external temperature sensor including a temperature reaction portion that reacts to a temperature change of the cylindrical portion, the external temperature sensor being mounted on an outer peripheral surface of the cylindrical portion;

a weld nut welded to the outer peripheral surface of the cylindrical portion to mount the external temperature sensor on the outer peripheral surface of the cylindrical portion; and a bolt that fixes the external temperature sensor to the weld nut, the method comprising:

a first step of welding the weld nut to the outer peripheral surface of the cylindrical portion;

a second step of welding the compression mechanism to the inner peripheral surface of the cylindrical portion;

a third step of welding the top portion and the bottom portion of the casing to the cylindrical portion; and a fourth step of mounting the external temperature sensor on the outer peripheral surface of the cylindrical portion, the compressor being manufactured in order of the first step, the second step, the third step, and the fourth step.

2. A compressor comprising:

a casing having a cylindrical portion, an external temperature sensor including a sensor portion and a mounting portion, the sensor portion measuring a temperature of the cylindrical portion and the mounting portion being mounted on the cylindrical portion and pressing the sensor portion so that the sensor portion is in close contact with an outer peripheral surface of the cylindrical portion;

a weld nut welded to the outer peripheral surface of the cylindrical portion to mount the mounting portion to the cylindrical portion; and a bolt that fixes the mounting portion to the weld nut.

3. The compressor according to claim 2, wherein a plurality of the weld nuts is arranged along a first direction, and the first direction is an axial direction of the cylindrical portion.

4. The compressor according to claim 3, wherein a position of the sensor portion along the first direction falls within a range of a fixing portion along the first direction, and the fixing portion fixes the compression mechanism to the cylindrical portion.

5. The compressor according to claim 3, wherein the weld nut is welded to the outer peripheral surface of the cylindrical portion by projection welding or spot welding.

6. The compressor according to claim 3, wherein the weld nut is welded to the outer peripheral surface of the cylindrical portion by projection welding.

7. The compressor according to claim 3, wherein the mounting portion includes an attaching bracket and an attaching spring, and the attaching bracket brings the sensor portion into close contact with the cylindrical portion.

8. The compressor according to claim 3, wherein the sensor portion further includes a temperature reaction portion and an elastic heat transfer sheet mounted between the temperature reaction portion and the cylindrical portion.

9. The compressor according to claim 3, wherein the sensor portion includes a temperature reaction portion, the cylindrical portion has an outer diameter ranging from 80 mm to 160 mm, and a length of the temperature reaction portion along a circumferential direction of the cylindrical portion ranges from 10 mm to 20 mm.

10. The compressor according to claim 2, wherein the weld nut is welded to the outer peripheral surface of the cylindrical portion by projection welding or spot welding.

11. The compressor according to claim 10, wherein the mounting portion includes an attaching bracket and an attaching spring, and the attaching bracket brings the sensor portion into close contact with the cylindrical portion.

12. The compressor according to claim 10, wherein the sensor portion further includes a temperature reaction portion and an elastic heat transfer sheet mounted between the temperature reaction portion and the cylindrical portion.

13. The compressor according to claim 10, wherein the sensor portion includes a temperature reaction portion, the cylindrical portion has an outer diameter ranging from 80 mm to 160 mm, and a length of the temperature reaction portion along a circumferential direction of the cylindrical portion ranges from 10 mm to 20 mm.

14. The compressor according to claim 2, wherein
the weld nut is welded to the outer peripheral surface of the cylindrical portion by projection welding.

15. The compressor according to claim 2, wherein
the mounting portion includes an attaching bracket and an attaching spring, and
the attaching bracket brings the sensor portion into close contact with the cylindrical portion.

16. The compressor according to claim 15, wherein
the sensor portion further includes a temperature reaction portion and an elastic heat transfer sheet mounted between the temperature reaction portion and the cylindrical portion.

17. The compressor according to claim 15, wherein
the sensor portion includes a temperature reaction portion,
the cylindrical portion has an outer diameter ranging from 80 mm to 160 mm, and
a length of the temperature reaction portion along a circumferential direction of the cylindrical portion ranges from 10 mm to 20 mm.

18. The compressor according to claim 2, wherein
the sensor portion includes a temperature reaction portion,
the cylindrical portion has an outer diameter ranging from 80 mm to 160 mm, and
a length of the temperature reaction portion along a circumferential direction of the cylindrical portion ranges from 10 mm to 20 mm.

19. An outdoor unit of an air conditioner comprising:
the compressor according to claim 2.

20. A compressor comprising:
a casing having a cylindrical portion;
a compression mechanism fixed to an inner peripheral surface of the cylindrical portion;
an external temperature sensor including a temperature reaction portion that reacts to a temperature change of the cylindrical portion, the external temperature sensor being mounted on an outer peripheral surface of the cylindrical portion;
a weld nut welded to the outer peripheral surface of the cylindrical portion to mount the external temperature sensor on the outer peripheral surface of the cylindrical portion; and
a bolt that fixes the external temperature sensor to the weld nut,
the external temperature sensor further including an elastic heat transfer sheet mounted between the temperature reaction portion and the cylindrical portion.

21. The compressor according to claim 20, wherein
the cylindrical portion has an outer diameter ranging from 80 mm to 160 mm, and
a length of the temperature reaction portion along a circumferential direction of the cylindrical portion ranges from 10 mm to 20 mm.

22. An outdoor unit of an air conditioner comprising:
the compressor according to claim 20.

* * * * *